United States Patent [19]

Ikehata et al.

[11] 4,074,093

[45] Feb. 14, 1978

[54] SWITCHING MECHANISM IN AN ELECTRONIC WATCH

[75] Inventors: Yukio Ikehata, Matsudo; Masataka Ikenishi, Soka; Shozo Kushida, Narashino; Tadahiro Kikuchi, Tokyo, all of Japan

[73] Assignee: Kabushiki Kaisha Daini Seikosha, Japan

[21] Appl. No.: 614,958

[22] Filed: Sept. 19, 1975

[30] Foreign Application Priority Data

Sept. 24, 1974 Japan ..... 49-109814

[51] Int. Cl.[2] ..... H01H 3/32; G04C 3/00

[52] U.S. Cl. ..... 200/52 R; 200/153 V; 58/23 R; 58/50 R; 58/85.5

[58] Field of Search ..... 200/33 R, 36, 37, 38 B, 200/153 L, 153 LB, 153 V, 52 R; 58/23, 34, 19 R, 50 R, 63, 73, 80, 85.5, 40 B

[56] References Cited

U.S. PATENT DOCUMENTS

| | | | |
|---|---|---|---|
| 3,519,777 | 7/1970 | Kaiser | 200/153 V X |
| 3,526,088 | 9/1970 | Meitinger | 58/63 X |
| 3,581,028 | 5/1971 | Valbona | 200/153 V X |
| 3,733,803 | 5/1973 | Hiraga et al. | 58/23 R |
| 3,762,153 | 10/1973 | Komiyama et al. | 58/23 R |
| 3,841,081 | 10/1974 | Komaki | 58/23 R |
| 3,945,190 | 3/1976 | Kimura et al. | 58/4 A |
| 3,975,896 | 8/1976 | Kasama | 58/23 R |
| 3,975,897 | 8/1976 | Naito | 58/23 R |
| 3,978,296 | 8/1976 | Moriya et al. | 200/4 |

*Primary Examiner*—James R. Scott

*Attorney, Agent, or Firm*—Robert E. Burns; Emmanuel J. Lobato; Bruce L. Adams

[57] ABSTRACT

A switching mechanism in an electronic watch including a clicking mechanism comprising a clicking cam which is mounted for rotation on an operative rod and a spring which is fixed to a base plate. The clicking cam is provided with a peripheral projecting portion. The spring is provided with a convex portion. In a switching operation, the projecting portion of the cam engages with the convex portion of the spring during the rotation of the cam which is rotated together with the operative rod. After passing through a dead point where the cam disengages with the spring, the cam continues to rotate due to the restoring force of the spring. Then, a click sound is produced at the engagement and the disengagement therebetween.

2 Claims, 2 Drawing Figures

FIG. 1
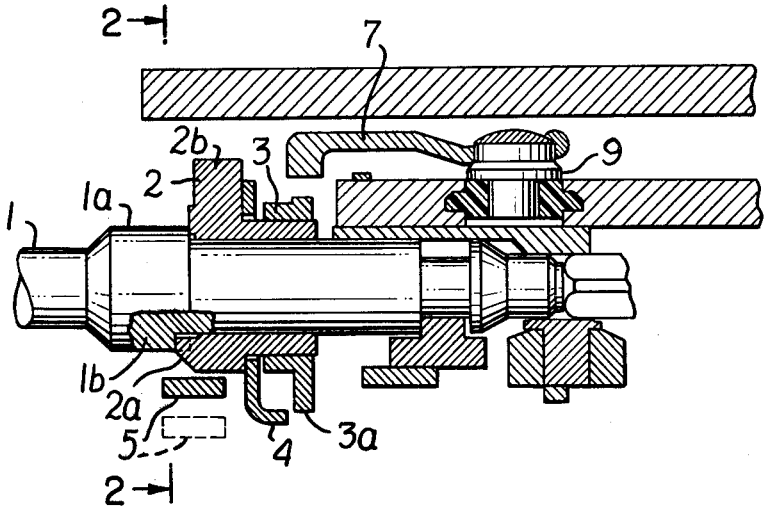
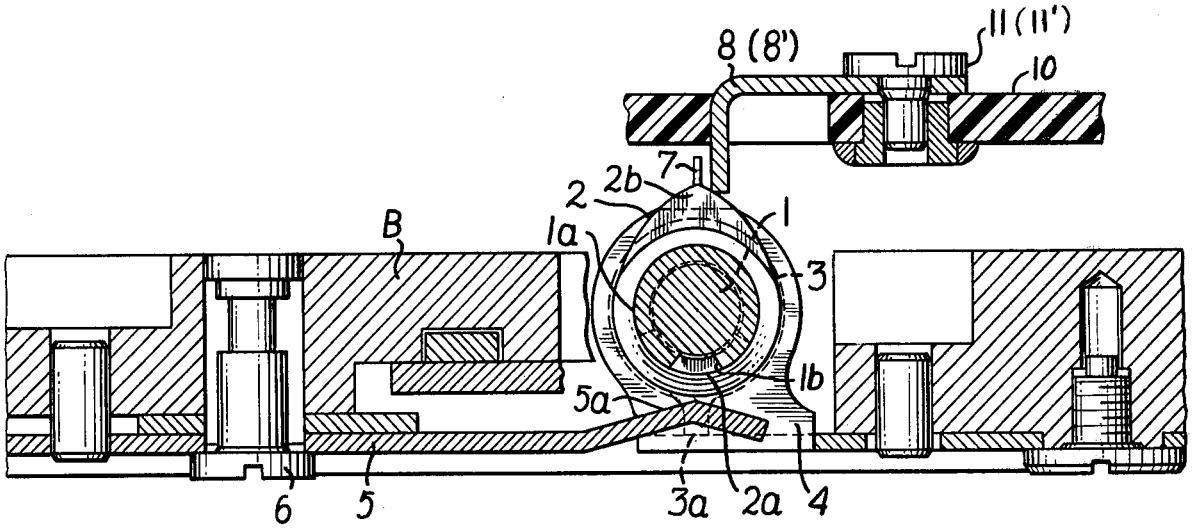
FIG. 2

SWITCHING MECHANISM IN AN ELECTRONIC WATCH

BACKGROUND OF THE INVENTION

This invention relates to a switching mechanism is an electronic watch and more particularly to a click mechanism belonging to the switching mechanism.

Since various operations in the electronic watch are electrically effected, the mechanical forces required to actuate switches for controlling these operations are so light that misoperations which cause troubles are liable to occur.

SUMMARY OF THE INVENTION

It is therefore an object of the present invention to provide an improved switching mechanism to prevent a miss in a switching operation of an electronic watch.

It is another object of the present invention to provide an improved switching mechanism to produce clicks during a switching operation.

BRIEF DESCRIPTION OF THE DRAWINGS

FIG. 1 is a sectional view showing an operative mechanism which is used in a second adjustment switch mechanism of the present invention; and FIG. 2 is a sectional view taken on the line 2—2 in FIG. 1.

FIG. 3*a* illustrates a rod 1 shown in FIG. 1;

FIG. 3*b* illustrates the angular extent of a peripherasl notch in the rod illustrated in FIG. 3*a;*

FIG. 3*c* illustrates a clicking cam 2 and switch operating cam 3 shown in FIG. 1;

FIG. 3*d* illustrates the angular extent of a projection on the clicking cam shown in FIG. 3*c;*

FIG. 4 is a top plan view of the mechanism illustrated in FIGS. 1 and 2; and FIG. 5 is a bottom plan view of the mechanism illustrated in FIGS. 1 and 2.

DESCRIPTION OF THE PREFERRED EMBODIMENT

The present invention will be fully described by way of reference to the embodiment illustrated in the accompanying drawings.

In FIGS. 1 and 2, an operative rod 1 such as a winding stem is provided with a thick portion 1*a* in which a notched portion 1*b* is formed. Around the operative rod 1, a first or clicking cam 2 is mounted. The cam 2 is provided with a projection 2*a* at its portion corresponding to the notched portion 1*b*. A second or switching cam (seconds adjustment cam) 3 is mounted around the operative rod 1 together with the clocking cam 2. Cams 2 and 3 are respectively provided with projecting portions 2*b* and 3*a* which are held in axial position by a holding lever 4. A spring 5 is provided with a convex portion 5*a* at its tip. The base end of the spring 5 is fixed to a base plate B by means of a screw 6. The spring 5 is pushed down by the cam 2 when the top of the convex portion 5*a* strikes against the projecting portion 2*b* of the cam 2 and engages therewith during the rotation of the cam 2. Then, since the spring 5 causes the clicking cam 2 to push up, the cam 2 further rotates due to the restoring force of the spring 5. A numeral 7 designates a contact spring connected to insulated terminal 9. Numerals 8 and 8' designate a contact member which is connected to a seconds adjustment logic circuit and which is connected to terminal 11 (11') mounted on the circuit board 10.

In the mechanism constructed as mentioned above, when the operative rod (winding stem) 1 is rotated after it is moved to a first position where the notched portion 1*b* engages with the projection 2*a* for the clicking cam 2, the cams 2 and 3 rotate together with the operative rod 1. During the rotation of the switching cam 3, the projecting portion 3*a* of the cam 3 makes the contact spring 7 temporarily deflect, whereby the contact ring 7 contacts with the contact member 8 or 8'. Therefore, for example, the seconds adjustment logic circuit in an electric circuit is operated so as to effect an adjustment of the watch seconds inication. With the clicking cam 2, as the projecting portion 2*a* of the cam 2 strikes against the convex portion 5*a* of the spring 5 and engages therewith during the rotation of the operative rod 1, the spring is pushed down in spite of its spring force. When cam 2 passes the convex portion 5*a* of the spring 5 in its further rotation (that is it passes through a dead point), the cam 2 is reversely pushed up by the restoring force of the spring 5 so that it continuously rotates. The rotation of the cam 2 is driven more quickly than that of the operative rod 1 due to the restoring force of the spring 5, since the width of the projection 2*a* is smaller than the notched portion 1*b* of the operative rod. It is appreciated that the rotation of the cam 2 is stopped when the projection 2*a* of the cam 2 strikes against the notched portion 1*b* of the operative rod.

Since the switching mechanism which is constructed according to the present invention is operated as mentioned above, it is possible to avoid a miss or error in the switching operation of the electronic watch and to prevent unintentional rotations of the winding stem which are caused when a winding crown of the watch touches with an arm or dresses. Further, this mechanism is suitable for use as the seconds adjustment because the number of clicks is indicitative of the adjustment times when one click corresponds to a one second adjustment. Therefore, the practical implimentation of the invention is very great.

What is claimed is:

1. A switching mechanism in an electronic timepiece comprising:

a. a rod mounted for axial rotation and having a peripheral notch extending peripherally thereof for a certain angular interval;

b. mounting means mounting said rod for axial rotation;

c. a first cam mounted for rotation on said rod and having a projection opposite the peripheral notch of said rod for engaging therewith to rotate with said rod and having dimensions less than said peripheral notch to allow said first cam to rotate on said rod relative thereto, and having an eccentric peripheral portion;

d. a resilient spring-like member having a free end positioned to bear against the periphery of said first cam as said first cam rotates upon rotation of said rod, said eccentric peripheral portion engaging said free end as said first cam is rotated relative thereto and bending said spring-like member and the bent spring-like member bearing against said eccentric peripheral portion to accelerate said first cam relative to said rod as said eccentric peripheral portion rotates past the free end of said spring-like member;

e. a second cam mounted for rotating concurrently with said first cam and having a peripheral projection; and f. contact switch means defining a contact switch operated by the peripheral projection of said second cam, said contact switch means being positioned relative to said second cam to be engaged and operated by the peripheral projection of said second cam as said first cam is accelerated relative to said rod whereby operation of said contact switch is for an interval determined by the acceleration of said first cam to a rate of rotation greater than the rate of rotation of said rod.

2. A switching mechanism according to claim 1, wherein said spring-like member when bent develops sufficient force to sufficiently accelerate said first cam that said first cam makes an audible click when its rotation relative to said rod is limited by said projection engaging said peripheral notch.

* * * * *